United States Patent [19]

Rakacs

[11] 4,109,591

[45] Aug. 29, 1978

[54] BUTTONHOLE SEWING PRESSER DEVICE WITH INTERLOCK FINGER

[75] Inventor: Joseph G. Rakacs, Toms River, N.J.

[73] Assignee: The Singer Company, New York, N.Y.

[21] Appl. No.: 828,354

[22] Filed: Aug. 29, 1977

[51] Int. Cl.[2] ..... D05B 3/24

[52] U.S. Cl. ..... 112/76; 112/77

[58] Field of Search ..... 112/76, 77, 70, 73, 112/158 B, 235

[56] References Cited

U.S. PATENT DOCUMENTS 3,877,403 4/1975 Ketterer ..... 112/77

FOREIGN PATENT DOCUMENTS 1,172,936 6/1964 Fed. Rep. of Germany ..... 112/77

*Primary Examiner*—H. Hampton Hunter

*Attorney, Agent, or Firm*—Robert E. Smith; Edward L. Bell

[57] ABSTRACT

A finger mounted on the work engaging plate that interlocks with the work engaging pressor foot of a buttonhole sewing presser device to effectively prevent travel of the work engaging shoe when the presser foot is raised for work insertion. In addition the finger will prevent accidental disengagement when the buttonhole sewing pressor device tilts after the pressor foot has been raised.

3 Claims, 4 Drawing Figures

Fig. 1
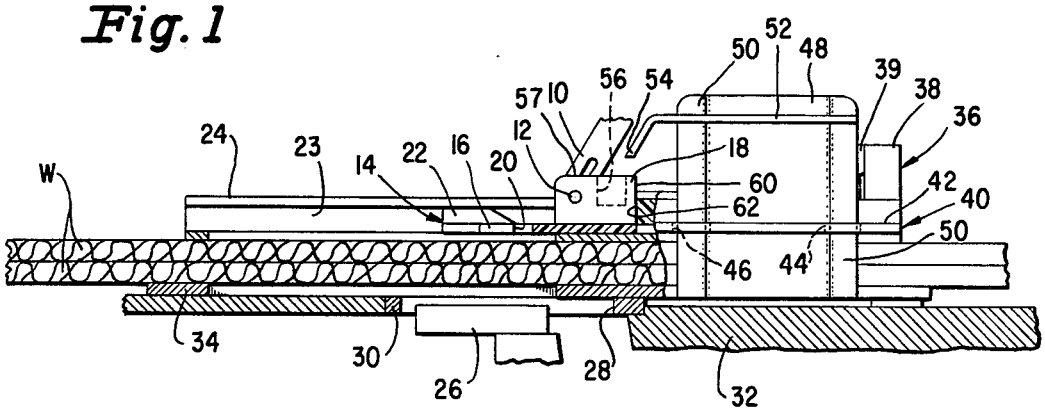
Fig. 2
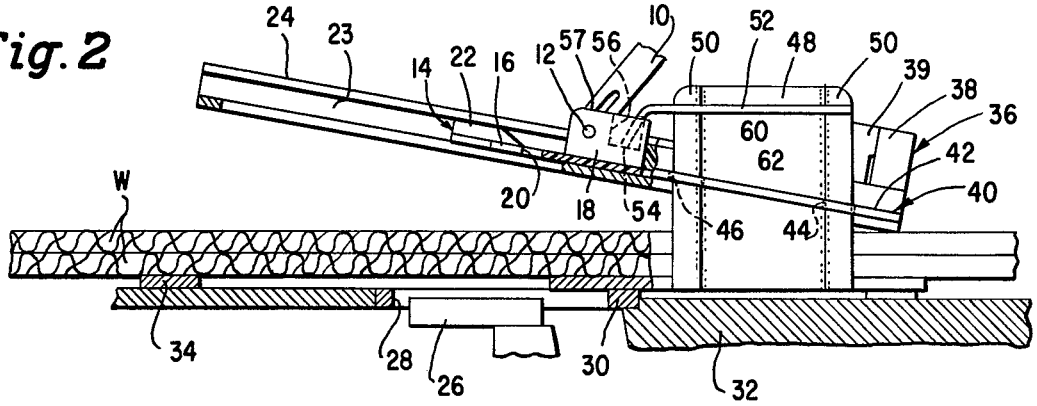
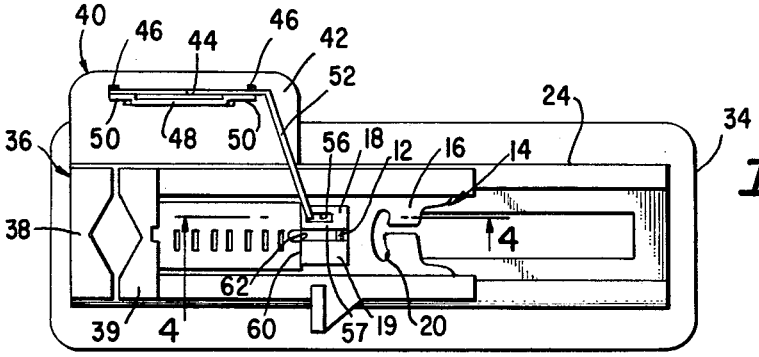
Fig. 3
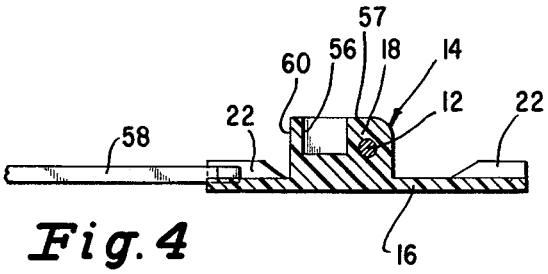
Fig. 4

BUTTONHOLE SEWING PRESSER DEVICE WITH INTERLOCK FINGER

BACKGROUND OF THE INVENTION

This invention relates to buttonhole sewing presser devices for sewing machines employing a traveling shoe which moves with the work fabric relatively to the presser foot during the sewing of the buttonhole and particularly of the type having a work engaging plate which contacts the opposite side of the work fabric from the traveling shoe. Reference is made to the U.S. Pat. No. 3,877,403, Apr. 15, 1975 of S. J. Ketterer, which discloses the type of buttonhole sewing presser device to which this invention may be applied, which patent is incorporated herein by reference. In this type of buttonhole sewing presser device the position of the traveling shoe is used to indicate or control the length of buttonhole being stitched. In order to make a buttonhole of the desired length, therefore, it is necessary for the traveling shoe to occupy the proper starting position at the beginning of buttonhole sewing and if the traveling shoe is accidentally shifted out of the initial position during insertion of work fabric, one side of the resulting buttonhole will be too short.

SUMMARY OF THE INVENTION

It is the object of this invention to provide an interlock effective when the buttonhole sewing presser device is raised for work insertion to hold the traveling shoe in the proper starting position. This objective is attained by mounting an interlock arm on the work engaging plate which cooperates with interlock abutment means on the presser foot. Since no appreciable upward or angular movement of the work engaging plate occurs during removal or insertion of work fabrics in contrast with the appreciable upward and angular movements of the presser foot, a large relative movement between these parts provides for favorable interlock which is insensitive to minor variations in the relative positions of the parts.

DESCRIPTION OF THE DRAWINGS

The accompanying drawing illustrate a preferred form of this invention in which:

FIG. 1 is a side view of the buttonhole sewing presser device with fragments of a sewing machine showing the presser foot lowered and the parts positioned in readiness to sew a buttonhole.

FIG. 2 is a side view of the buttonhole sewing presser device of FIG. 1 partially broken away illustrating the interlock when the presser foot is raised.

FIG. 3 is a top plan view of the buttonhole sewing presser device.

FIG. 4 is a cross-section along line 4—4 of FIG. 3.

DESCRIPTION OF THE PREFERRED EMBODIMENT

FIGS. 1 and 2 of the accompanying drawings are of a presser device for sewing buttonholes of the type disclosed in referenced U.S. Pat. No. 3,877,403, Apr. 15, 1975: The buttonhole sewing presser device comprises a presser shank 10 which engages a pivot pin 12 carried by a presser foot 14. The presser foot member, as best illustrated in FIG. 4, includes a generally rectangular base plate 16 from which rise a pair of spaced tangs 18 and 19 which carry the pivot pin 12. The base plate 16 is also formed with a needle accommodating aperture

20 for the passage of a sewing machine needle in the formation of stitches which make up the buttonhole. Upturned flanges 22 at each corner of the base plate 16 are snuggly embraced by a track 23 formed along each side of a traveling shoe member 24 thus slideably to guide the traveling shoe member relatively to the presser foot 14. With the construction of this invention only a minimum of clearance is required between the flanges 22 and the tracks 23.

As explained in the U.S. Pat. No. 3,877,403 the traveling shoe member 24 of the buttonhole sewing presser device moves back and forth with the work fabrics W as the work fabrics are transported relatively to the sewing machine by the feed dog 26 of the sewing machine during the sewing of the buttonhole. As illustrated in FIGS. 1 and 2, the feed dog 26 operates upwardly through slots 28 in a throat plate 30 carried on the work supporting bed 32 of the sewing machine to feed the work fabrics W lengthwise along the buttonhole during the sewing operation. A work engaging plate 34 is also associated with the traveling shoe member 24 and is moveable with the shoe during the formation of buttonholes. When the presser foot is elevated as shown in FIG. 2, the traveling shoe member 24 will be elevated so that the work fabrics may be inserted or removed from between the work engaging plate 34 and the traveling shoe member 24. When the presser foot member is lowered, the parts will assume the positions illustrated in FIG. 1 and the work will be clamped between the traveling shoe member 24 and the work engaging plate 34 in readiness for the sewing of the buttonhole.

Attached to the rear of the traveling shoe member 24 is one half of a button measuring device 36, preferrably formed of a synthetic plastic material and including a button engaging jaw member 38. Slidably constrained opposite the jaw member 36 is a shiftable button engaging jaw member 39 which as explained in the U.S. Pat. No. 3,877,403, carries abutment elements which will be positioned in accordance with the size of a button placed between the jaw member 38 and 39 so as to influence the sewing machine controls during movement of the traveling shoe member 24 to sew a buttonhole of a size suitable to accept the button being gauged.

A support bracket 40 is fixed to the traveling shoe member 24 in a manner described in U.S. Pat. No. 3,877,403. The support bracket 40 is formed with a substantial planar portion 42 extending to one side of the traveling shoe 24 and arranged substantially parallel to the work engaging surface of the shoe. A non-circular aperture 44 is formed in the planar portion 42, the aperture 44 preferably taking the form a narrow straight slot elongated in the direction parallel to the traveling shoe 24. The slot may be formed with a small laterally extending branch 46 at each extremity and this is done solely to facilitate the design of a punch to produce the aperture in such a way that burrs may be eliminated at the extremities of the slot.

Cooperating with the aperture 44 in the support bracket 40 is a projection 48 bent upwardly at a substantially right angle from the work engaging plate 34. The projection 48 is preferably formed with lateral offsets 50 at each side so that the overall thickness of the projection can match closely the width of the aperture 44 and this overall width may exceed the thickness of the sheet metal of which the work engaging plate 34 is made.

The projection 48 which is part of the work engaging plate 34 has a depending interlock finger 52 which extends forward of projection 48, and also is bent at an angle so that the free extremity will terminate in a downwardly bent tip 54 that is positioned over the tang 18 of the presser foot 14. The tang 18, as illustrated in FIGS. 3 and 4, is formed in its top surface 57 with a recess 56 adapted to accommodate the downwardly bent tip 54 of the interlock finger 52 to effect a lock between the presser foot and both the work engaging plate as well as the traveling shoe member 24. A flat coil spring 58 is engaged with the presser foot 14 as shown in FIG. 3, and is constrained at the opposite extremity in the button gauging portion 38 which is attached to the traveling shoe member 24. The coil spring serves to bias the traveling shoe relatively to the presser foot member into the position as shown in FIGS. 1 and 2. In this extreme spring biased position the back walls 60 of the tangs 18 and 19 and the front surface 62 of the button gauging foot 38 serve as abutment members locating the presser foot and traveling shoe member in extreme relative position.

In the extreme relative position of the presser foot 14 and traveling shoe member 24 toward which the spring 58 biases the parts, elevation of the buttonhole presser device by raising of the presser foot member 14 as shown in FIG. 2 will enable the tip 54 of the interlock finger to enter the recess 56 of the tang 18. The interlock elements, when engaged, prevent movement of the traveling shoe member 24 relatively to the presser foot member during insertion or removal of work fabrics, and therefore, when the presser foot is lowered into position as shown in FIG. 1, the operator of the sewing machine can be assured that the traveling shoe member 24 will begin at the extreme position of the traveling shoe member as dictated by the engaged abutment surfaces 60 and 62. Full travel of the traveling shoe member 24 during the sewing of each leg of the buttonhole will then be assured and formation of perfect buttonholes can be expected with each machine operation. When the presser foot member 14 is lowered into the position as illustrated in FIG. 1, the dimension of the interlock finger is such as to provide vertical clearance therebetween as shown clearly in FIG. 1 permitting free travel of the shoe member 24 relative to the presser foot member 14.

Having set forth the nature of this invention what I claim herein is:

1. A buttonhole sewing presser device of the type having a presser foot adapted to be secured to a vertically shiftable sewing machine presser bar, a traveling shoe positionable upon work fabrics being stitched and slidably engaged on the presser foot, a work engaging plate positionable under the work fabrics being stitched, and means interconnecting said work engaging plate and said traveling shoe insuring sliding movement of said work engaging plate together with said travelling shoe relatively to said presser foot with capacity for movement of said traveling shoe toward and away from said work engaging plate when said presser foot is lowered and raised, the improvement which comprises interengagable interlock elements carried on said presser foot and on said work engaging plate, said interlock elements being shiftable out of engagement so as to free said traveling shoe when said presser foot is lowered, and into engagement so as to prevent sliding movement of said traveling shoe relatively to said presser foot when said presser foot is raised.

2. A buttonhole sewing presser device as set forth in claim 1 in which said means interconnecting said work engaging plate and said traveling shoe comprises a projection formed on said work engaging plate and slidably arranged through an aperture formed in said traveling shoe, and in which said interlock elements comprise an arm having a downwardly extending free extremity carried on said projection at the opposite side of the traveling shoe from the work engaging plate, and a tang formed on the upper surface of said presser foot and adapted to occupy a position in interferring relation with said free arm extremity to provide said interlock.

3. A buttonhole sewing presser device as set forth in claim 2 in which said tang on the upper surface of said presser foot is formed with an upwardly open recess for accommodating the free extremity of said arm in the engaged position of said interlock elements.

* * * * *